US007955104B1

(12) United States Patent
Wicks et al.

(10) Patent No.: US 7,955,104 B1
(45) Date of Patent: Jun. 7, 2011

(54) SHORTING CLIP TERMINAL CONNECTOR ASSEMBLY INCLUDING PROTRUSION SHIELD

(75) Inventors: John Wicks, Cortland, OH (US); Mark D. McCall, Hubbard, OH (US); Nicole L. Liptak, Cortland, OH (US); Paul S. Lam, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/719,584

(22) Filed: Mar. 8, 2010

(51) Int. Cl.
*H01R 29/00* (2006.01)

(52) U.S. Cl. ..... 439/188

(58) Field of Classification Search ..... 439/188, 439/513; 200/51.1
See application file for complete search history.

(56) References Cited

U.S. PATENT DOCUMENTS

| | | | | |
|---|---|---|---|---|
| 4,906,203 | A * | 3/1990 | Margrave et al. | 439/188 |
| 5,529,507 | A * | 6/1996 | Felix et al. | 439/188 |
| 5,571,030 | A * | 11/1996 | Gladd et al. | 439/489 |
| 5,733,135 | A * | 3/1998 | Kennedy et al. | 439/188 |
| 5,788,520 | A * | 8/1998 | Roche | 439/188 |
| 5,944,547 | A * | 8/1999 | Golab et al. | 439/188 |
| 6,149,465 | A * | 11/2000 | Berg et al. | 439/630 |
| 6,257,910 | B1 * | 7/2001 | Mramor | 439/188 |
| 6,315,588 | B1 * | 11/2001 | Heberlein et al. | 439/188 |
| 6,431,895 | B1 * | 8/2002 | Hung | 439/241 |
| 6,435,894 | B2 * | 8/2002 | Little et al. | 439/352 |
| 6,648,693 | B1 * | 11/2003 | Hogan et al. | 439/630 |
| 6,659,785 | B2 * | 12/2003 | Nakamura et al. | 439/188 |
| 6,663,411 | B2 * | 12/2003 | Little | 439/352 |
| 6,663,421 | B1 * | 12/2003 | Glick et al. | 439/507 |
| 7,347,738 | B2 | 3/2008 | Hsieh et al. | |
| 7,402,057 | B1 * | 7/2008 | Strang et al. | 439/188 |
| 7,497,708 | B2 * | 3/2009 | Geismayr et al. | 439/188 |
| 2002/0009924 | A1 * | 1/2002 | Little et al. | 439/625 |
| 2002/0137397 | A1 * | 9/2002 | Little | 439/686 |
| 2004/0229487 | A1 * | 11/2004 | Lutsch et al. | 439/188 |
| 2006/0009080 | A1 * | 1/2006 | Regnier et al. | 439/637 |
| 2007/0049084 | A1 * | 3/2007 | Geismayr et al. | 439/188 |

* cited by examiner

*Primary Examiner* — T C Patel
*Assistant Examiner* — Vladimir Imas
(74) *Attorney, Agent, or Firm* — Jimmy L. Funke

(57) ABSTRACT

A shorting clip terminal connector assembly electrically shorts together terminals in a first connector body dependent on connection status of a first and a second connector body. A shorting clip terminal disposed in a shorting clip terminal cavity in the first connector body receives a protrusion disposed on the second connector body. When the second connector body is mated with the first connector body, the protrusion engages a lift element of the shorting clip terminal in the shorting clip terminal cavity thereon and urges the lift element to lift contact elements of the shorting clip terminal away from the terminals in the shorting clip terminal cavity enabling insertion of protrusion side walls intermediate the contact elements and the terminals in the shorting clip terminal cavity. The contact elements of the shorting clip terminal do not make electrical contact with the terminals and the protrusion side walls further shield the contact elements from making electrical contact with the terminals.

20 Claims, 9 Drawing Sheets

SHORTING CLIP TERMINAL CONNECTOR ASSEMBLY INCLUDING PROTRUSION SHIELD

TECHNICAL FIELD

This invention is directed to a shorting clip terminal connector assembly. More particularly, a provision on a second connector body assures that a shorting clip terminal does not electrically short a first terminal with a second terminal in a first connector body when it should not.

BACKGROUND OF INVENTION

It is known to use a shorting clip terminal in an automotive vehicle to electrically short an electrical signal provided on a terminal with another electrical signal provided on another terminal to selectively affect the performance of an electrical circuit. Referring to FIG. 1, a common prior art shorting clip terminal (1) is illustrated. The shorting clip terminal (1) includes a front end (2) and a contact point (3). Referring to FIG. 2, the terminal (1) is mounted in a cavity (4) of the housing (5). A wall portion (6) of the housing (5) assists to hold the terminal (1) within the cavity (4) and separates the shorting clip terminal (1) from electrical contact with another adjacent terminal (7) in the housing (5). Other electrical connections in the housing (5) affected by electrical contact with the terminal (1) are not shown. The contact point (3) of the terminal (1) is disposed adjacent the wall portion (6) and is detached from the adjacent terminal (7) by an air gap (8). Other adjacent terminals in the housing (5) are separated by electrical contact with the terminal (1) by similar air gaps. As shown in FIG. 2, terminal (1) is operating in a first operation state where the shorting clip terminal (1) does not make electrical contact with the terminal (7) and with the other terminals (not shown) in the housing (5). A second operation state of the shorting clip terminal is produced when the shorting clip terminal electrically connects the associated terminals in the housing (5) together through the shorting clip terminal (1) altering electrical performance of connected electrical circuits that is different from the electrical performance attained with the first operation state.

Referring to FIG. 2A, environmental exposure of the housing in an automotive vehicle may degrade the reliability of the housing (5) and the wall portion (6) such that the air gap (8) decreases between the shorting clip terminal (1) and the terminal (7). Undesired degradation and creep of the wall portion (6), as shown in phantom line in FIG. 2A, may cause collapse of the air gap (8) such that the contact points (3) of the shorting clip terminal (1) move towards, and make electrical contact (9) with corresponding terminals (7) of the housing to produce the second operation state of the shorting clip terminal when the second operation state is not desired. The shorting clip terminal may also incur undesired damage if the wall portion does not properly seat beneath the front end of the terminal in the cavity of the housing upon insertion from outside the cavity. Damage to the shorting clip terminal may also cause further undesired concomitant damage within the cavity of the housing. A damaged shorting clip terminal is inoperable. Replacing damaged components may increase service costs for the shorting clip terminal and the housing.

What is needed is an improved shorting clip terminal connector assembly to reliably produce the first operation state and the second operation state of the shorting clip terminal while decreasing damage to the shorting clip terminal.

SUMMARY OF THE INVENTION

According to one embodiment of the invention, a shorting clip terminal connector assembly includes a first connector body disposed along a longitudinal axis. The first connector body defines cavities including at least a shorting clip terminal cavity and at least a first and a second cavity different from the shorting clip terminal cavity. The shorting clip terminal also includes a least a first and a second terminal. The first cavity is configured to axially receive the first terminal and said second cavity is configured to axially receive the second terminal. The first terminal provides a first electrical signal and the second terminal provides a second electrical signal. The shorting clip terminal connector assembly includes a shorting clip terminal. The shorting clip terminal cavity is configured to axially receive the shorting clip terminal. The shorting clip terminal includes a lift element and at least a first and a second contact element. The first contact element is configured to be in electrical communication with the first terminal and the second contact element is configured to be in electrical communication with the second terminal. The shorting clip terminal connector assembly includes a second connector body being axially mateable with the first connector body and including a protrusion in alignment with the shorting clip terminal cavity. The protrusion includes at least a first protrusion side wall and a second protrusion side wall. When the second connector body is connected with the first connector body, the protrusion is inserted in the shorting clip terminal cavity and engages the lift element and urges the shorting clip terminal such that the first and the second contact element are lifted away from being in contact with at least the first and the second terminal. When the contact elements are moved away from the terminals, this enables insertion of the first protrusion side wall intermediate the first terminal and the first contact element and insertion of the second protrusion side wall intermediate the second terminal and the second contact element within the shorting clip terminal cavity. The first and the second contact element do not make electrical contact with the first and the second terminal. The first electrical signal of the first terminal and the second electrical signal of the second terminal are not electrically shorted together through electrical contact with the shorting clip terminal. The first and the second protrusion side wall further provide a shield to prevent the first contact element from making electrical contact with the first terminal and the second contact element from making electrical contact with the second terminal.

In another embodiment of the invention, a method to assemble a shorting clip terminal connector assembly for electrically shorting a first terminal with a second terminal dependent on a connection status of a first and a second connector body is provided. One step in the method is providing a shorting clip terminal. The shorting clip terminal includes a lift element and a first and a second contact element. Another step in the method is providing a first connecter body including a shorting clip terminal cavity adapted to receive the shorting clip terminal. The first connector body includes a first and a second terminal. The first terminal provides a first electrical signal and the second terminal provides a second electrical signal. The shorting clip terminal is configured to make electrical contact with the first terminal and the second terminal. A further step in the method is providing a second connector body mateable with the first connector body. The second connector body includes a protrusion in alignment with the shorting clip terminal cavity. Another step in the method is providing a first terminal and a second terminal. A further step in the method is inserting the shorting clip terminal into the shorting clip terminal cavity in the first connector body. Another step in the method is inserting the first terminal into a first cavity and the second terminal into a second cavity in the first connector body. The first cavity is adapted to receive the first terminal and said second cavity is adapted to receive the second terminal. The inserted first terminal is configured to slide under and lift the first contact element of the shorting clip terminal from the first cavity and into a ready position in the shorting clip terminal cavity while still being in contact with the first terminal. The inserted second terminal is configured to slide under and lift the second contact element of the shorting clip terminal from the second cavity and into a ready position in the shorting clip terminal cavity while still being in contact with the second terminal. Another step in the method is connecting the second connector body with the first connector body such that the protrusion is received and supported into the shorting clip terminal cavity and slideably engages with the lift element of the inserted shorting clip terminal. The protrusion urges the lift element to lift the first and the second contact element away from contact with the first terminal and the second terminal in the shorting clip terminal cavity to enable insertion of the first protrusion side wall intermediate the first terminal and the first contact element and insertion of the second protrusion side wall intermediate the second terminal and the second contact element such that the first and the second contact element do not make electrical contact with the first terminal and the second terminal. The first electrical signal of the first terminal and the second electrical signal of the second terminal are not electrically shorted together through electrical contact with the shorting clip terminal. The first and the second protrusion side wall further provide a shield to prevent the first contact element from making electrical contact with the first terminal and the second contact element from making electrical contact with the second terminal when the first connector body is mated with second connector body.

In yet another embodiment of the invention, a shorting clip terminal connector assembly includes a first connector body and a second connector body. The first connector body is mateable with the second connector body along an axis. The first connector body defines a shorting clip terminal cavity and a pair of laterally spaced terminal cavities. The shorting clip terminal cavity is in communication with the pair of terminal cavities. The shorting clip terminal connector assembly further includes a first and a second terminal being disposed in the terminal cavities, respectively. The shorting clip terminal connector assembly includes a shorting clip terminal axially disposed within the shorting clip terminal cavity. The shorting clip terminal has a first and a second contact element configured to contact the first and the second terminal when the first connector body is disconnected from the second connector body. The shorting clip terminal further includes a lift element generally in alignment with the first and the second contact element perpendicular to the axis when the shorting clip terminal is disposed in the shorting clip terminal cavity. The lift element is disposed intermediate the first and the second contact element. The second connector body includes an axially extending shorting clip lift protrusion. The lift protrusion is adapted to deflect the lift element and disconnect the first and the second contact element from the first and the second terminal as the first and second connector body are mated without contacting the first and the second contact element.

BRIEF DESCRIPTION OF THE DRAWINGS

This invention will be further described with reference to the accompanying drawings in which.

DETAILED DESCRIPTION OF THE PREFERRED EMBODIMENT

Figure 1:
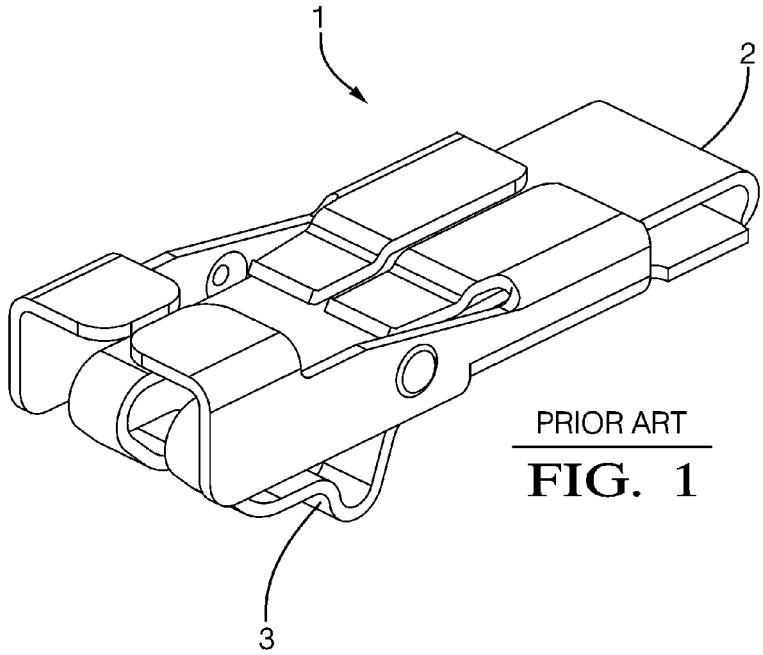
PRIOR ART FIG. 1
FIG. 1 is a perspective view of a prior art shorting clip terminal, showing details thereof.
Figure 2:
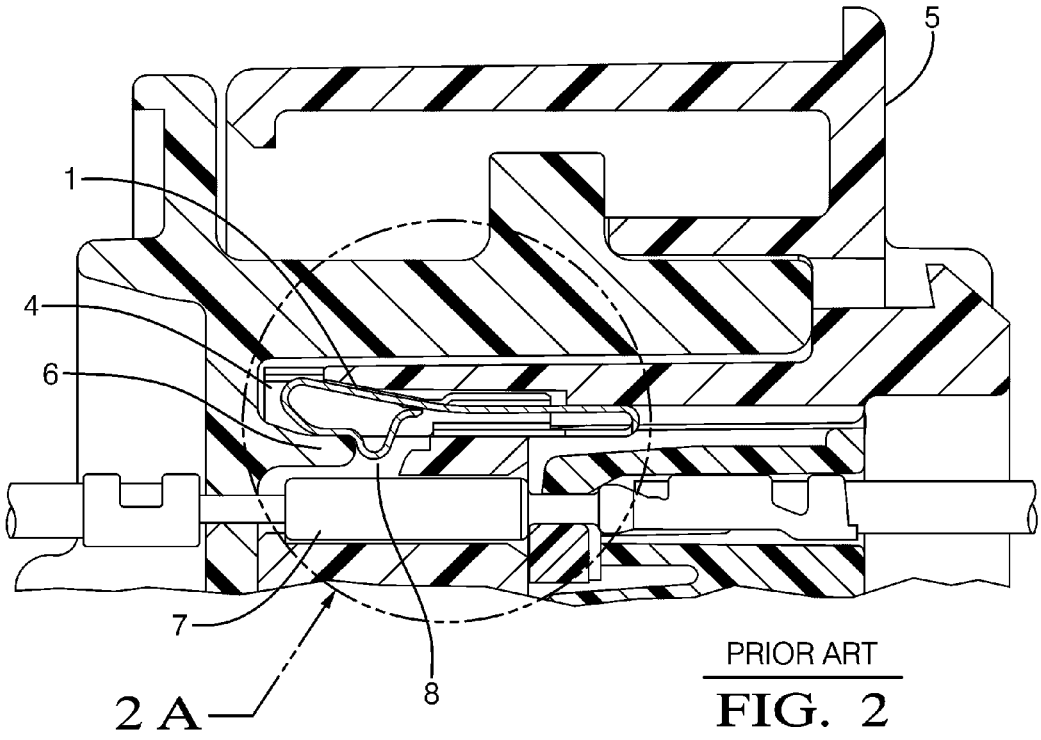
PRIOR ART FIG. 2
FIG. 2 is a cross section side view of the prior art shorting clip terminal in FIG. 1 in a housing with a contact of the shorting clip spaced apart from an adjacent terminal by an air gap.
Figure 2A:
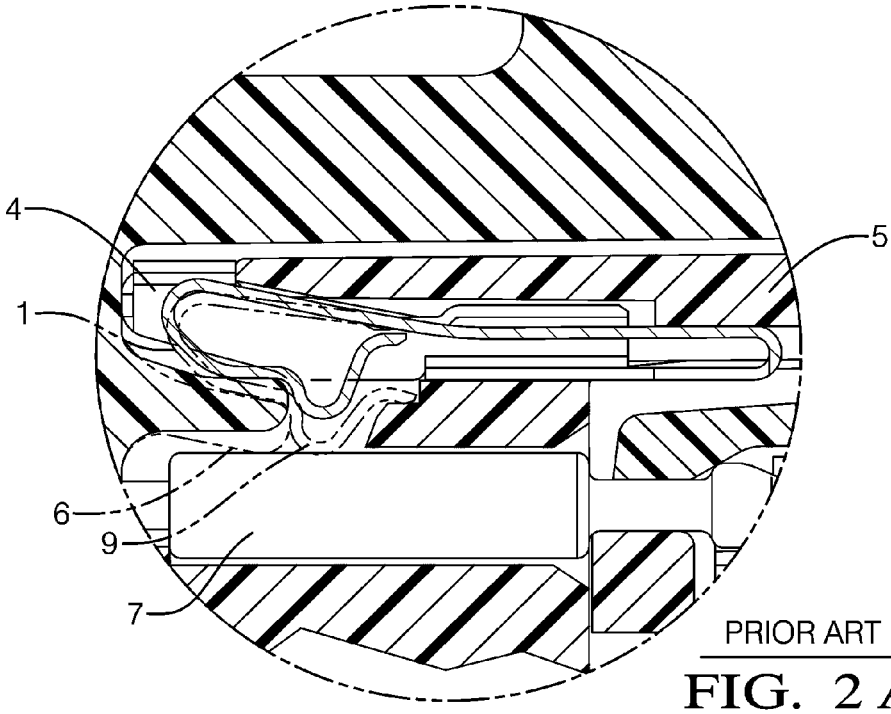
PRIOR ART FIG. 2 A
FIG. 2A is a magnified cross section side view of a portion of the housing including the prior art shorting clip terminal in FIG. 2, showing details thereof.
Figure 3:
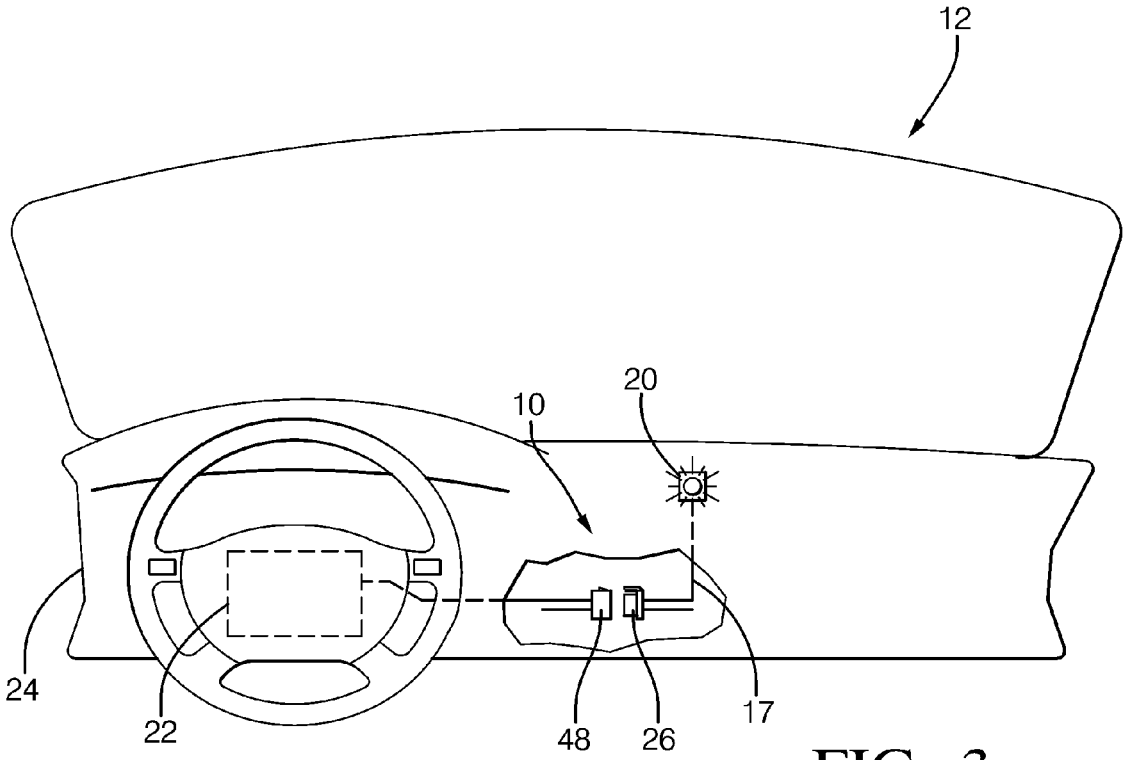
FIG. 3 is a frontal view of an interior vehicle compartment including a shorting clip terminal connector assembly with a first connector body being disconnected from a second connector body in accordance with the invention.
Figure 4:
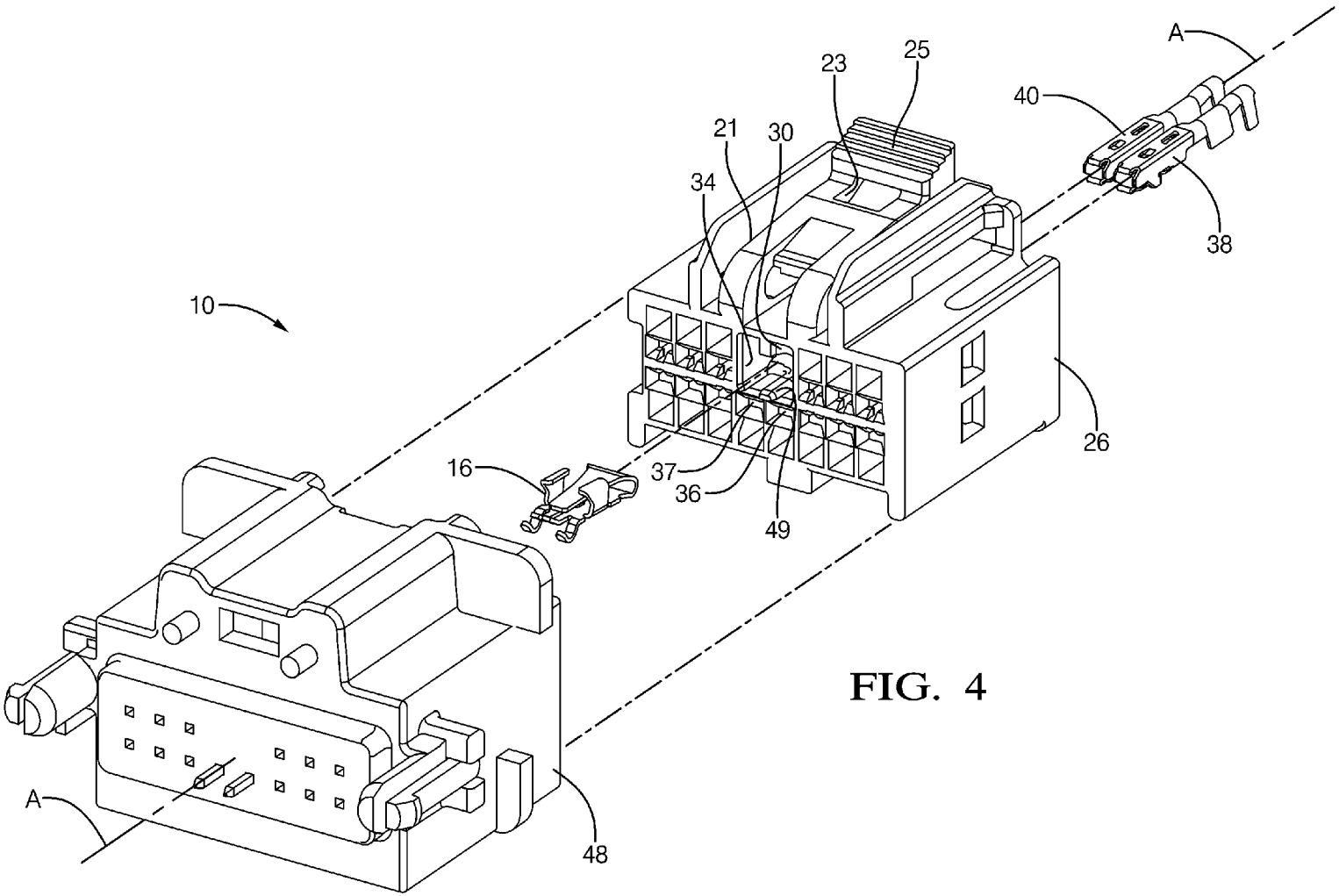
FIG. 4 is an exploded perspective view of the shorting clip terminal connector assembly in FIG. 3.

Referring to FIGS. 3-4, a shorting clip terminal connector assembly 10 is provided in accordance with one aspect of the invention in an interior compartment 12 of a vehicle (not shown). Assembly 10 includes a shorting clip terminal 16 disposed within assembly 10. When the shorting clip terminal connector assembly is assembled, the shorting clip terminal operates in a first operation state that does not alter the normal operation of an electrical circuit affected by the shorting clip terminal. When connector bodies of assembly 10 are disconnected, as illustrated in FIG. 3, shorting clip terminal 16 is configured in a second operation state where the performance of an electrical circuit 17 is altered from the first operation state. An indicator light 20 for an air bag system 22 in the vehicle illuminates on an instrument panel 24 of the vehicle. Illumination of the air bag indicator light provides visual indication for a service technician that the air bag in the vehicle is inoperative so the air bag may be serviced without possible inadvertent deployment. A shorting clip terminal connector assembly may be used for each distinct air bag system in the vehicle to assist with safe serviceability of the vehicular air bag systems. The shorting clip terminal connector assembly may be used in a variety of electrical connection systems and is not limited by a specific size of wire conductor or pin terminal used in the electrical connection systems.

Figure 12:
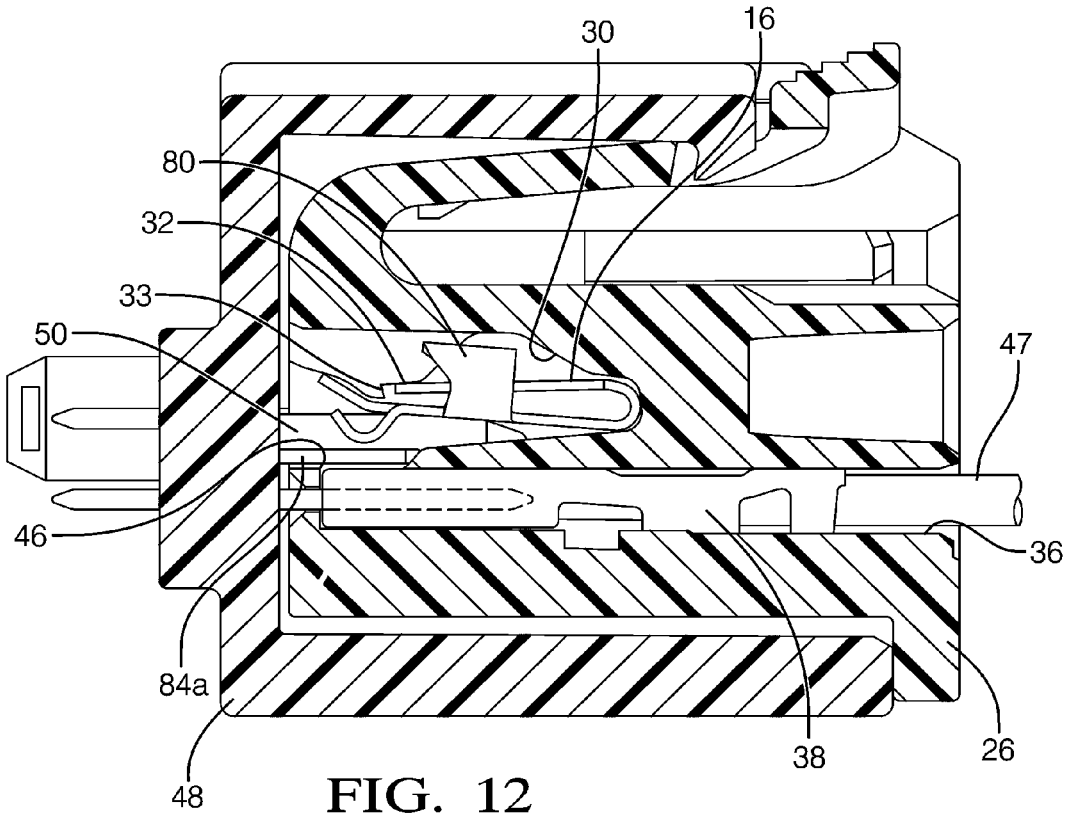
FIG. 12 is a cross section view of the shorting clip terminal connector assembly in FIG. 4 with a first connector body mated with a second connector body and the shorting clip terminal being in a first operation state.

Referring to FIGS. 4 and 12, assembly 10 includes a first connector body 26 disposed along a longitudinal axis A. First connector body 26 includes a plurality of cavities, one of which is a shorting clip terminal cavity 30. Other cavities in first connector body 26 include cavities that are different from shorting clip terminal cavity 30. Cavity 30 is sized and configured to receive shorting clip terminal 16, and shorting clip terminal 16 is generally axially disposed in cavity 30. Cavity 30 includes an inner wall 32 that transitions into a shoulder 33 proximate an opening 34 of cavity 30. Shoulder 33 is configured to secure shorting clip terminal 16 in cavity 30 after insertion of shorting clip terminal 16 through opening 34 from outside cavity 30 of first connector body 26.

A first cavity 36 and a second cavity 37 are disposed in first connector body 26 adjacent cavity 30. First cavity 36 is laterally adjacent and spaced apart from second cavity 37. Cavities 36, 37 underlie shorting clip terminal cavity 30. Cavities 36, 37 are configured to receive terminals different from shorting clip terminal 16. A first female terminal 38 is disposed in first cavity 36. A second female terminal 40 is disposed in cavity 37. Female terminals 38, 40 are received in cavities 36, 37 in a first axial direction and shorting clip terminal is received in cavity 30 in a second axial direction opposite the first axial direction. Terminals 38, 40 may be constructed from an electrically conducting material, preferably copper alloy.

First connector body 26 defines a first aperture 46 therethrough between cavity 30 and first cavity 36 and a second aperture (not shown) between cavity 30 and second cavity 37. Shorting clip terminal cavity 30 includes a supporting rib 49 disposed intermediate the apertures that provides support to protrusion 50 when protrusion 50 is inserted in cavity 30 when second connector body 48 is mated with first connector body 26. Shorting clip terminal 16 is configured to make electrical contact with first female terminal 38 and second female terminal 40 through the apertures in first connector body 26. First aperture 46 is generally in alignment with second aperture (not shown) in a direction perpendicular to axis A in cavity 30. First aperture 46 and second aperture (not shown) are proximate opening 34 of cavity 30. Female terminals 38, 40 are in electrical communication with wire conductors 47 that have electrical signals from electrical circuits remote from assembly 10 in the vehicle. Alternately, female terminals 38, 40 may be in direct electrical connection to printed circuit boards through pin terminals. Still yet alternately, the female terminals may be male terminals or other type terminals that are not female terminals.

Figure 8:
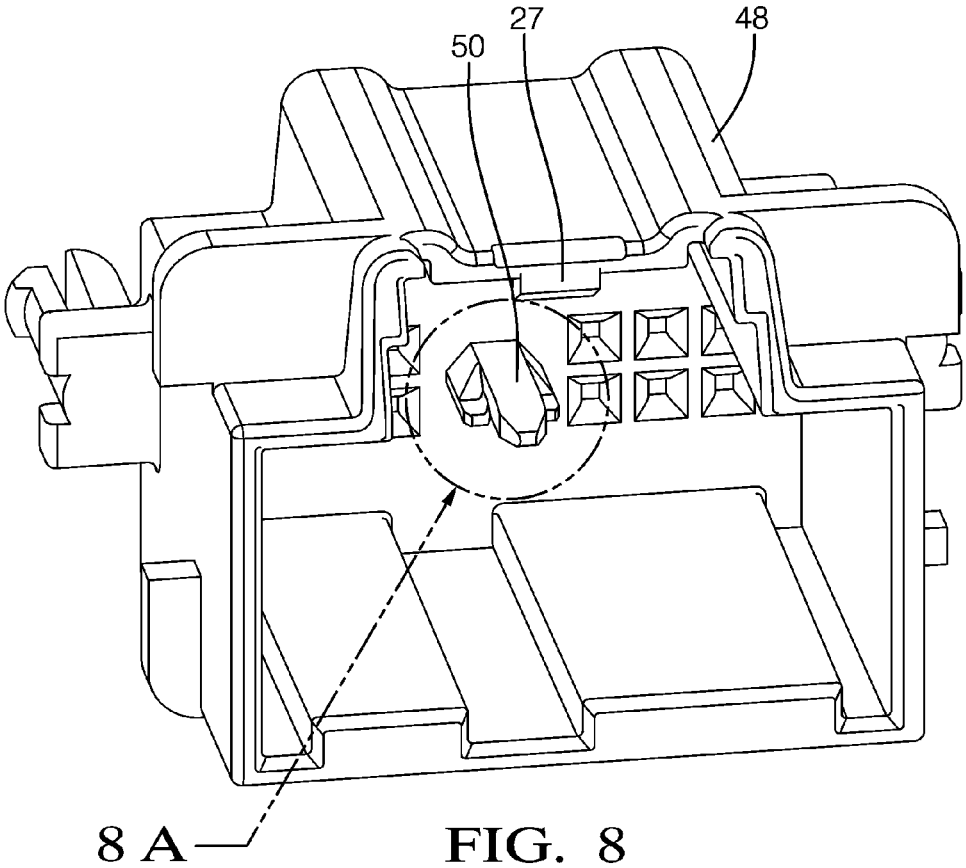
FIG. 8 is a perspective view of a protrusion disposed in a second connector body of the shorting clip terminal connector assembly of FIG. 4.
Figure 8A:
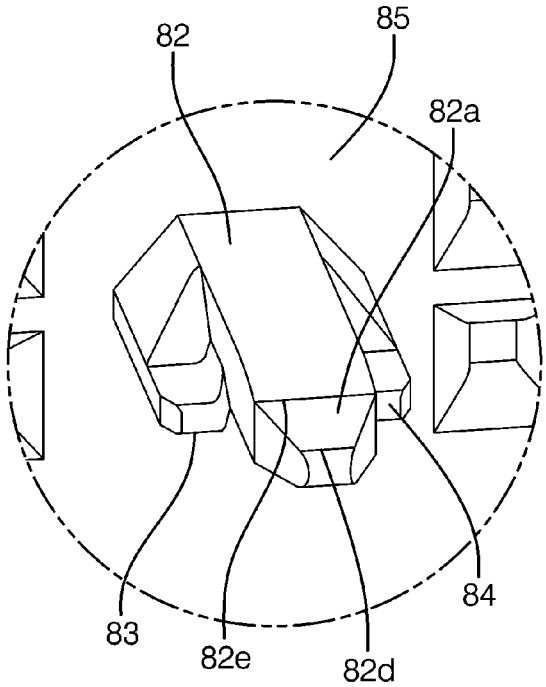
FIG. 8A is a magnified view of a the protrusion disposed on a portion of the second connector body in FIG. 8.
Figure 9:
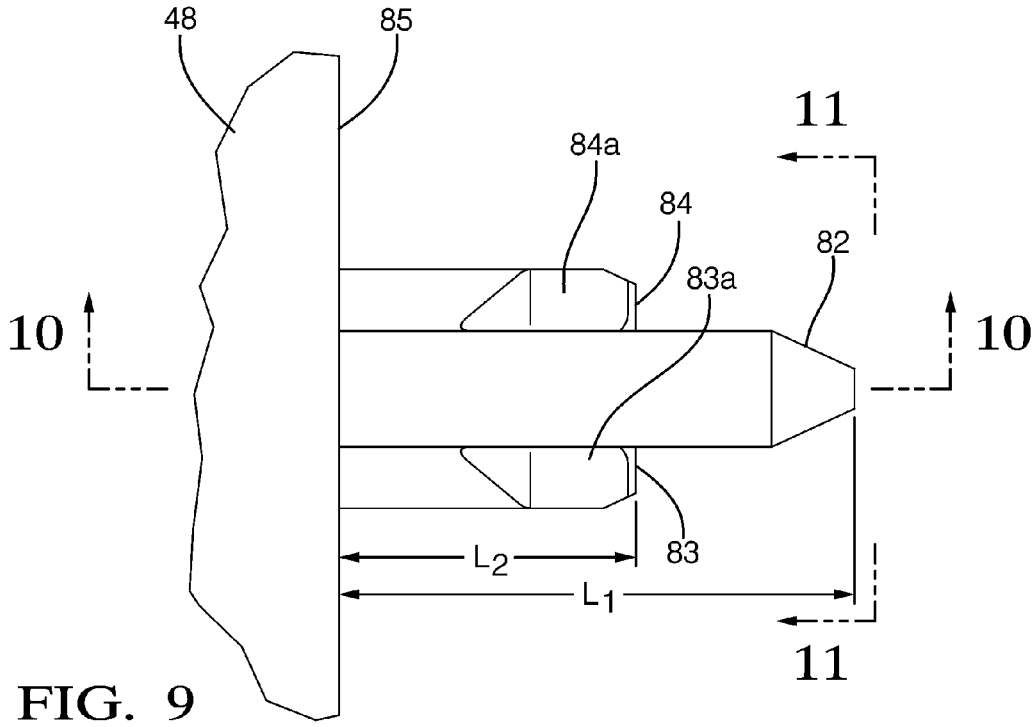
FIG. 9 is a top view of the protrusion of FIG. 8A.
Figure 10:
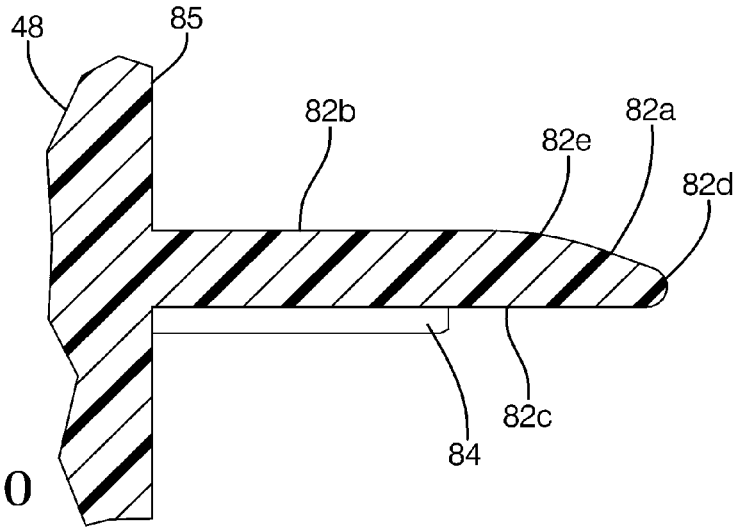
FIG. 10 is a cross section view of the protrusion of FIG. 9, taken along line 10-10 in the direction of the arrows.

Referring to FIGS. 4 and 8, assembly 10 includes a second connector body 48 axially mateable with first connector body 26. First connector body 26 is mated with second connector body 48 when second connector body 48 locks with first connector body 26 through a primary locking mechanism 21 securing the connector bodies 26, 48. The primary locking mechanism includes a lock slot 23, a lock arm 25, and a locking tab 27. Second connector body 48 is mated with first connector body 32 when a locking tab 27 in second connector body 48 is inserted into lock slot 23 in lock arm 25 of the first connector body 26. Second connector body 48 including protrusion 50 makes connection with first connector body 26 before second connector body 48 mates with first connector body 26. Second connector body 48 is unlocked from first connector body 26 for second connector body to be disconnected from first connector body 26. Corresponding male terminals included with the second connector body align with female terminals in the first connector body and mate with corresponding female terminals in the first connector body when the second connector body is mated with the first connector body.

Second connector body 48 includes a plurality of cavity openings at least one of which includes a protrusion 50 disposed in a location that is not a cavity opening. Protrusion 50 extends away from an inner surface 85 of second connector body 48. The plurality of cavity openings and the protrusion on second connector body 48 align with the corresponding plurality of cavities on first connector body 26. Protrusion 50 aligns with shorting clip terminal cavity 30. The plurality of openings in the second connector body may be populated with terminals in connection to wires in electrical connection with other electronic circuits in the vehicle or directly connected with pin terminals to circuit boards. Cavity 30 in first connector body 26 is adapted to axially receive protrusion 50 upon connection of the second connector body 48 with first connector body 26. First and second connector body 26, 48 are constructed from a suitable electrically non-conducting material such as thermoset plastic.

Figure 5:
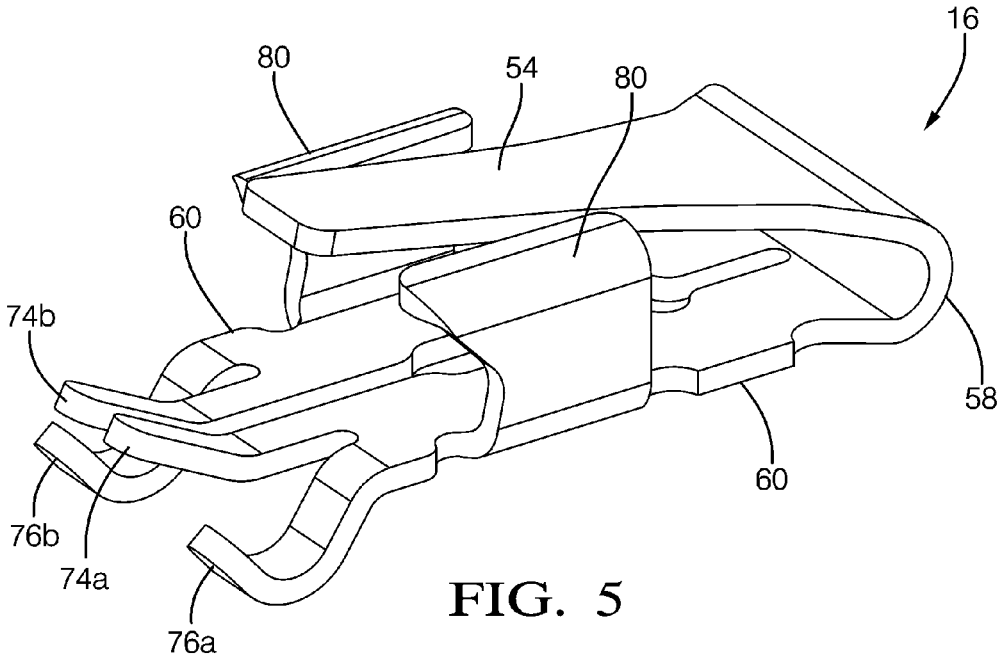
FIG. 5 is a perspective view of a shorting clip terminal used in the shorting clip terminal connector assembly in FIG. 4.
Figure 6:
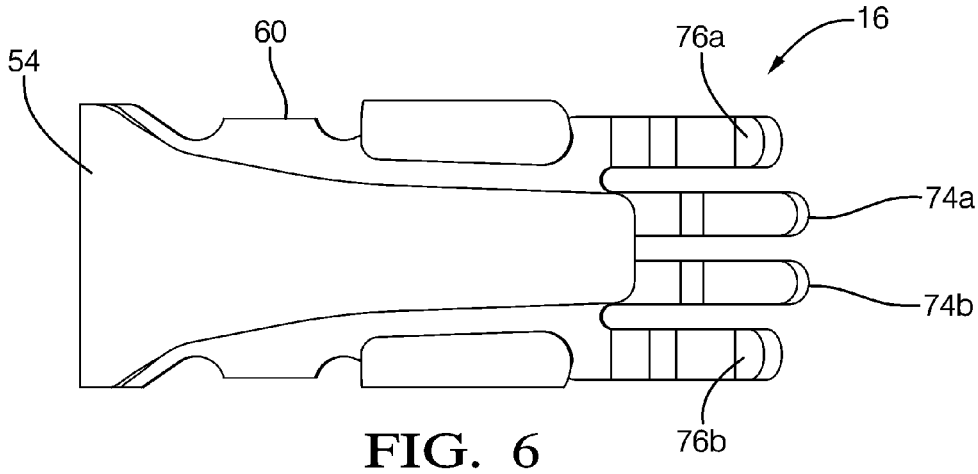
FIG. 6 is a top view of the shorting clip terminal in FIG. 5.
Figure 7:
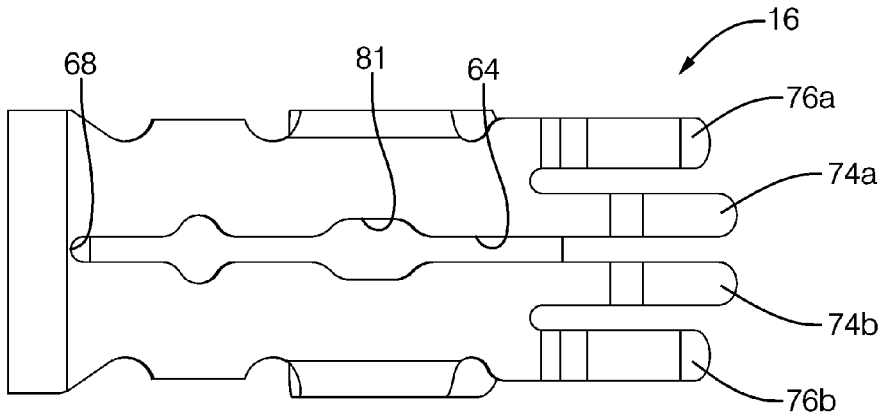
FIG. 7 is a bottom view of the shorting clip terminal in FIG. 5.

Referring to FIGS. 5-7, shorting clip terminal 16 has V-type shape and is formed from a single piece of metal material, preferably stainless steel or beryllium copper. Shorting clip terminal 16 includes a first leg 54 in connection with one end of a curved end 58 and a second leg 60 in connection with another end of curved end 58. Second leg 60 extends farther away from curved end 58 than first leg 54. Second leg 60 includes a plurality of second legs. Second leg 60 further defines a slot 64 between the plurality of second legs. Slot 64 has an open end remote from curved end 58. A closed end 68 of slot 64 is disposed adjacent curved end 58. Slot 64 includes holes 81 disposed along slot 64 to assist in the manufacture of shorting clip terminal 16. The holes may increase the tooling life of tools used to manufacture the shorting clip terminal and decrease manufacturing costs. Each second leg in the plurality of second legs has a fork-type shape including shaft portions transitioning into tines. Each second leg includes a lift tine, or lift element 74*a*, 74*b*, and a contact tine, or contact element 76*a*, 76*b*. Lift elements 74*a*, 74*b* are laterally spaced apart and generally in alignment in a direction perpendicular to axis A when the first connector body 26 is mated to second connector body 48. Lift element 74*a* is proximate lift element 74*b* and lift elements 74*a*, 74*b* are disposed in-bound from contact elements 76*a*, 76*b*. Elements 74*a*, 74*b*, 76*a*, 76*b* are disposed on the plurality of second legs of second leg 60 remote from curved end 58 of shorting clip terminal 16. Overstress tabs 80 assist to stabilize and keep shorting clip terminal 16 secure in cavity 30 during insertion and removal of protrusion 50 in shorting clip terminal cavity 30.

A plane defined along the shaft portions of the plurality of second legs of second leg 60 includes contact elements 76*a*, 76*b* a portion of each lift element 74*a*, 74*b* not residing in the plane. The portion of each lift element 74*a*, 74*b* not in the plane transitions from the other portion of each lift element disposed in the plane and connected with each shaft portion. The portion of each lift element 74*a*, 74*b* not in the plane is angled away from the other portion of each lift element in the plane in a first direction. The portion of lift elements 74*a*, 74*b* being angled away facilitate engagement with protrusion 50 and prevent buckling of shorting clip terminal 16 when protrusion 50 is inserted into cavity 30. Contact elements 76*a*, 76*b* transition from the shaft portions in second leg 60 in a second direction opposite the first direction. In-bound lift tines 74*a*, 74*b* are configured to allow protrusion 50 to urge and lift shorting clip terminal 16 away from first female terminal 38 and second female terminal 40 within cavity 30.

Contact element 76*a*, 76*b* have an arcuate shape. The arcuate shape of contact elements 76*a*, 76*b* facilitates electrical contact with respective female terminals 38, 40 when protrusion 50 is removed from cavity 30 when second connector body 48 is disconnected from first connector body 26. The design of shorting clip terminal 16, in cooperation with the material composition of shorting clip terminal 16, allow a spring tension of the shorting clip terminal to be exerted when first connector body 26 is disconnected from second connector body 48. Shorting clip terminal may be manufactured on a carrier strip that may decrease the potential of damaged shorting clip terminals during material handling when manufacturing the shorting clip terminal assembly. The contact elements of the shorting clip terminal may be plated with a precious metal, like gold, to increase the electrical conductivity between the contact elements of the shorting clip terminal and the first and the second terminal. Use of the carrier strip allows for more precise plating of contact elements where the contact elements make electrical contact with the terminals that may decrease material cost for precious metals used in the plating process.

Figure 11:
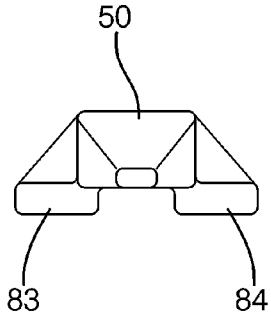
FIG. 11 is a front view of the protrusion of FIG. 9, taken along line 11-11 in the direction of the arrows.

Referring to FIGS. 8-11, protrusion 50 extends out away from second connector body 48. Protrusion 50 further includes a shorting clip lift protrusion, or main protrusion portion 82, a first protrusion side wall 83, and a second protrusion side wall 84. Main protrusion portion 82 is disposed intermediate first protrusion side wall 83 and second protrusion side wall 84 in a direction perpendicular to axis A. Referring to FIG. 11, protrusion 50 has a pontoon-boat shape with main protrusion portion 82 representing the platform of the pontoon boat and protrusion side walls 83, 84 being representative of the pontoons where first protrusion side wall 83 is spaced apart from second protrusion side wall 84 by main protrusion portion 82. Main protrusion body 82 has a first length $L_1$ and protrusion side walls 83, 84 have a second length $L_2$ and first length $L_1$ is greater than second length $L_2$.

Protrusion 50 is electrically non-conducting and may be injection molded with the second connector body 48. Main protrusion portion 82 has a wedge-shaped tip 82*a*. Tip 82*a* is remote from an inner surface 85 of second connector body 48. Main protrusion portion 82 includes a generally planer top surface 82*b* and a bottom surface 82*c*. Tip 82*a* includes a leading edge portion 82*d* and a trailing edge portion 82*e*. Leading edge portion 82*d* transitions into an inclined ramp leading towards trailing edge portion 82*e* and trailing edge portion 82*e* transitions to planar top surface 82*b* occurring over much of a majority portion of main body portion 82. Leading edge portion 82*d* of tip 82*a* initially engages lift elements 74*a*, 74*b* of main protrusion portion 82 when protrusion 50 is received in cavity 30. The bottom sides of protrusion side walls 83, 84 are in a parallel, spaced relationship with bottom surface 82*c* of main protrusion portion 82. The bottom sides of the protrusion side walls 83, 84 are adjacent the apertures of first connector body 26 when first connector body 26 is mated to second connector body 48.

First protrusion side wall 83 includes a planar portion 83*a* and second protrusion side wall 84 includes a planar portion 84*a*. Planar portions 83*a*, 84*a* are intermediate tip 82*a* of main protrusion portion 82 and surface 85 of second connector body 48. Planar portions 83*a*, 84*a* are parallel with axis A when second connector body 48 is mated with first connector body 26. Planar portions 83*a*, 84*a* have a top side and a bottom side opposite the top side. When second connector body 48 is mated with first connector body 26, protrusion 50 is inserted in cavity 30 such that contact elements 76*a*, 76*b* overlie and are spaced apart from portions 83*a*, 84*a*, respectively, in a direction perpendicular to axis A. A thickness of main protrusion portion 82 in relation with a thickness of portions 83*a*, 84*a* of protrusion side walls 83, 84 are each sufficiently thick to allow lift elements 74*a*, 74*b* to contact protrusion 50 and not allow contact elements to contact protrusion 50 when first connector body 26 is mated with second connector body 48 and when first connector body 26 is disconnected from second connector body 48.

The shorting clip terminal connector assembly electrically shorts the first terminal with the second terminal dependent on a connection status of a first connector body with the second connector body of the shorting clip terminal connector assembly. Referring to FIG. 12, when second connector body 48 is mated to first connector body 26, the open position, or first operation state of shorting clip terminal 16 is attained. As first connector body 26 and second connector body 48 are connected, shorting clip terminal cavity 30 axially receives protrusion 50. Leading edge portion 82*d* of tip 82*a* slideably engages lift elements 74*a*, 74*b* of shorting clip terminal 16. As protrusion 50 occupies an increasing portion of cavity 30 and main protrusion portion 82 deflects and lifts lift elements 74*a*, 74*b* with increased insertion of main protrusion portion 82, contact elements 76*a*, 76*b* are moved away from first and second female terminals 38, 40 in cavity 30 of first connector body 26. Tension builds in shorting clip terminal 16 as second leg 60 is pressed towards first leg 54 by main protrusion portion 82 and first leg 54 is forced against inner wall 32 of cavity 30. As second leg 60 engages top surface 82*b* of main protrusion portion 82, first protrusion side wall 83 is inserted intermediate first female terminal 38 and first contact element 76*a* within cavity 30 and second protrusion side wall 84 is inserted intermediate second female terminal 40 and second contact element 76*b* within cavity 30.

When second connector body 48 is mated with first connector body 26, protrusion 50 is inserted in cavity 30 such that contact elements 76*a*, 76*b* do not make electrical contact with the first female terminal 38 and the second female terminal 40. Contact elements 76*a*, 76*b* overlie and are spaced apart from respective portions 83*a*, 84*a* of protrusion side walls 83, 84. Contact elements 76*a*, 76*b* are also spaced apart from a surface of main protrusion portion 82. First portion 83*a* of first protrusion side wall 83 covers and overlies first aperture 46. Second portion 84*a* of second protrusion side wall 84 covers and overlies second aperture (not shown) similar to first aperture 46. Portions 83*a*, 84*b* of protrusion side walls 83, 84 provide a shield to ensure and keep first contact element 76*a* from making electrical contact with first female terminal 38 and second contact element 76*b* from making electrical contact with second female terminal 40. During insertion of protrusion 50 into cavity 30, contact elements 76*a*, 76*b* do not make contact with protrusion 50.

The first electrical signal provided on the first female terminal and the second electrical signal provided on the second female terminal are not electrically shorted together through electrical contact with the shorting clip terminal. Thus, in the first operation state, the first electrical signal associated with first terminal 38 and the second electrical signal associated with second terminal 40 are electrically unaffected when shorting clip terminal 16 is in the first operation state. The shorting clip terminal may operate in the first operation state for a majority portion of the product life of the shorting clip terminal connector assembly.

Figure 13:
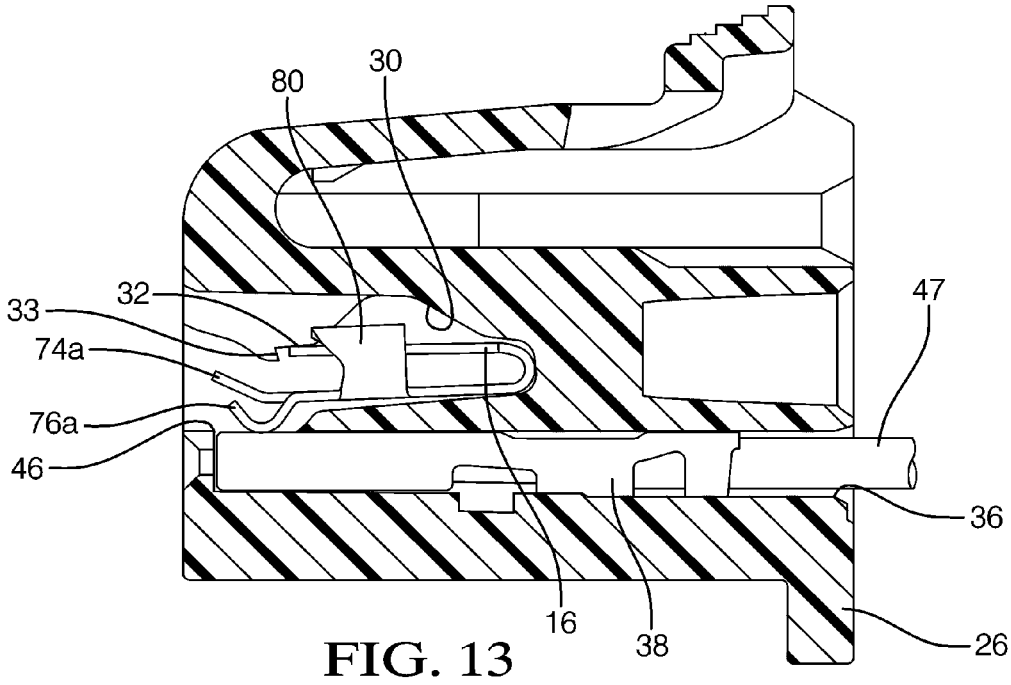
FIG. 13 is a cross section view of the shorting clip terminal assembly in FIG. 3 with the shorting clip terminal being in a second operation state.

Referring to FIGS. 3 and 13, when second connector body 48 is disconnected from first connector body 26, a closed position, or second operation state of the shorting clip terminal is attained. When second connector body 48 is being disconnected from first connector body 26, protrusion 50 slideably disengages from shorting clip terminal 16 for removal from cavity 30. When protrusion is removed from cavity 30, a tension force of shorting clip terminal 16 is exerted such that a first contact element 76*a* makes electrical contact with first female terminal 38 through first aperture 46 and second contact element 76*b* makes electrical contact with second female terminal 40 through second aperture (not shown) in cavity 30. Contact elements 76*a*, 76*b* electrically contact respective first and second female terminal 38, 40 with removal of protrusion 50 from cavity 30. When protrusion 50 disengages from cavity 30, contact elements 76*a*, 76*b* do not make contact with protrusion 50. In the second operation state, the shorting clip terminal does electrically short the first electrical signal of the first terminal with the second electrical signal of the second terminal through the shorting clip terminal. In the second operation state, the first electrical signal associated with the first terminal 38 and the second electrical signal associated with the second terminal 40 are electrically affected when the shorting clip terminal is in the second operation state.

It is desirable for contact elements 76*a*, 76*b* of shorting clip terminal 16 to not make contact with protrusion 50 when protrusion 50 is inserted in cavity 30 when first connector body 26 is mated with second connector body 48 and when protrusion 50 is disengaged from cavity 30 when first connector body 26 is unmated, or disconnected from second connector body 48. Should a piece of the protrusion break away from the protrusion due to contact from a contact element, the broken piece of protrusion may become lodged in an aperture causing the contact element of the shorting clip terminal to not make electrical contact with the female terminal when the second operation state of the shorting clip terminal is desired. Contact element contact with the protrusion may also cause the protrusion to scuff and mark the contact element such that intermittent electrical contact may result when the second operation state is realized.

While not limited to any particular theory, it is believed that slot 64 defined in the second leg 60 allows each leg in the plurality of second legs to operate independently of the other legs to make electrical contact with first and second terminal 38, 40 when protrusion 50 is removed from cavity 30. Closed end 68 of slot 64 being adjacent curved end 58 is effective to allow contact elements 76*a*, 76*b* of shorting clip terminal 16 to make electrical contact with first and the second female terminal 38, 40 taking into account the manufacturing tolerance variations in first and second connector body 26, 48, female terminals 38, 40, and shorting clip terminal 16. The placement of closed end 68 adjacent curved end 58 is not so great as to allow damage to shorting clip terminal 16, female terminals 38, 40, or first and second connector body 26, 48 due to the applied tension of contact elements 76*a*, 76*b* of shorting clip terminal 16 in making electrical contact with female terminals 38, 40. If the slot is terminated farther remote from the curved end, the contact elements may not make electrical contact with the female terminals with worst-case manufacturing tolerance variation of the components of the shorting clip terminal connector assembly.

Figure 14:
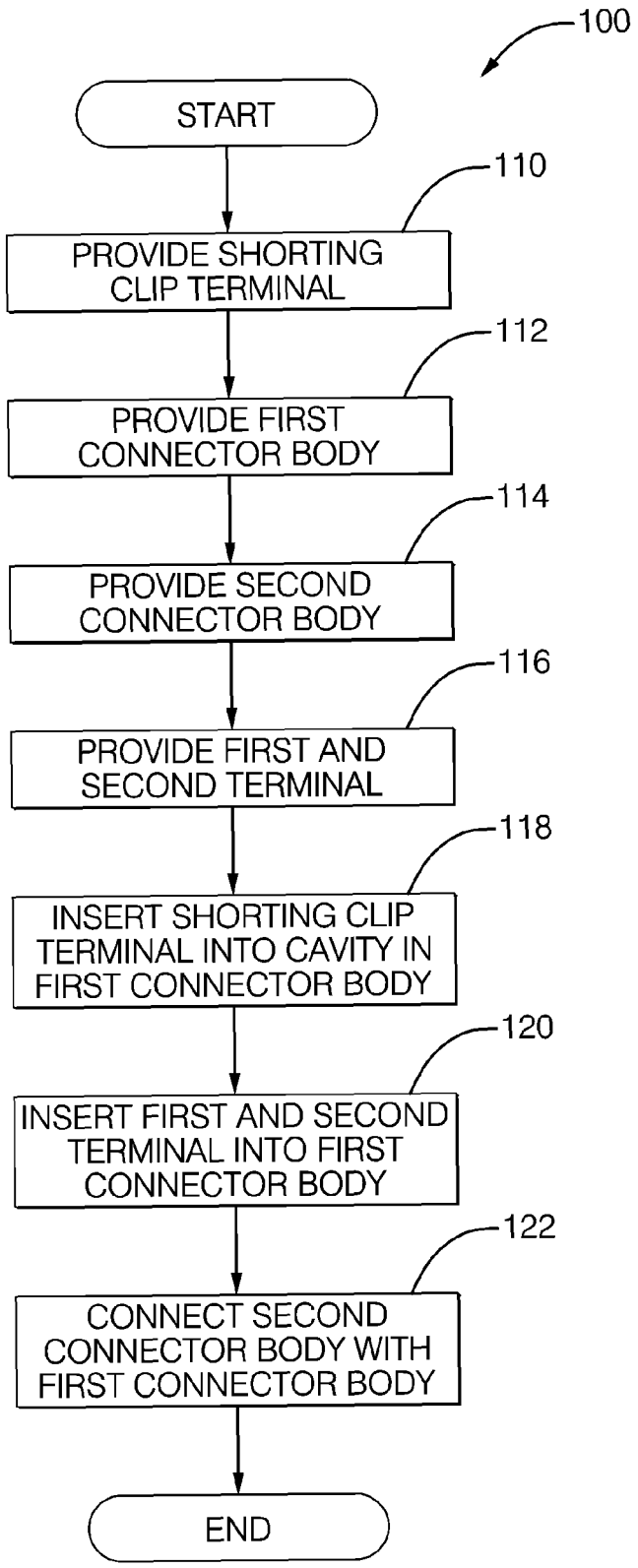
FIG. 14 is a flow diagram according to another embodiment of the invention.

Referring to FIG. 14, a method 100 is provided as another embodiment of the invention to assemble a shorting clip terminal connector assembly for selectively electrically connecting a first terminal with a second terminal. One step 110 in method 100 includes providing shorting clip terminal 16. Another step 112 in method 100 is providing first connector body 26. A further step 114 in method 100 is providing a second connector body 48. Another step 116 in method 100 is providing a first female terminal 38 and a second female terminal 40. The details of providing steps 110, 112, 114, and 116 are previously described herein. A further step 118 in method 100 is inserting shorting clip terminal 16 into shorting clip terminal cavity 30 in first connector body 26. Another step 120 in method 100 is inserting first female terminal 38 into first cavity 36 of first connector body 26 and second female terminal 40 into second cavity 37 in first connector body 26. Inserted first terminal 38 is configured to slide under and lift first contact element 76*a* of shorting clip terminal 16 from first cavity 36 and into a ready position in shorting clip terminal cavity 30 while still being in contact with first female terminal 38. Inserted second female terminal 40 is configured to slide under and lift second contact element 76*b* of shorting clip terminal 16 from second cavity 37 and into a ready position in shorting clip terminal cavity 30 while still being in contact with second female terminal 40. Attaining the ready position for the contact elements in step 120 is desired to prevent buckling of the shorting clip terminal with the insertion of the protrusion in the shorting clip terminal cavity if step 120 of method 100 was not employed. Undesired buckling damage of the shorting clip terminal may render the shorting clip terminal unusable. In yet a further step 122 of method 100 is connecting second connector body 48 with first connector body 26 such that protrusion 50 slideably engages with lift elements 74*a*, 74*b* of inserted shorting clip terminal 16 to urge shorting clip terminal 16 away from contact with first and second female terminal 38, 40 with increased insertion of protrusion 50 into cavity 30. With contact elements 76*a*, 76*b* moved away from terminals 38, 40, this enables insertion of first protrusion side wall 83 intermediate first terminal 38 and first contact element 76*a* and insertion of second protrusion side wall 84 intermediate second terminal 40 and second contact element 76*b* such that first and second contact element 76*a*, 76*b* do not make electrical contact with first terminal 38 and second terminal 40. The first electrical signal of first female terminal 38 and the second electrical signal of second female terminal 40 are not electrically shorted together through electrical contact with shorting clip terminal 16. First and second protrusion side wall 83, 84 further provide a shield to prevent first contact element 76*a* from making electrical contact with first terminal 38 and second contact element 76*b* from making electrical contact with second terminal 40 when first connector body 26 is mated with second connector body 48.

Alternately, the shorting clip terminal connector assembly may include only shorting clip terminal cavities and the associated terminal cavities electrically contacted by the shorting clip terminals. Still yet alternately, a shorting clip terminal connector assembly may only include a single shorting clip terminal cavity and the associated terminal cavities electrically contacted by the shorting clip terminal.

In another alternate embodiment of the invention, the choice of the amount of the independent suspension in the plurality of second legs may be tuned by the location of the closed end of the slot along the length of the second leg. The amount of independent suspension of the plurality of second legs becomes less as the closed end of the slot is moved increasingly remote from the curved end of the shorting clip terminal.

In yet a further alternate embodiment of the invention, the second leg is un-slotted and the main protrusion portion engages a single lift element.

In another alternate embodiment the shorting clip terminal cavity may not include a supporting rib.

Figure 15:
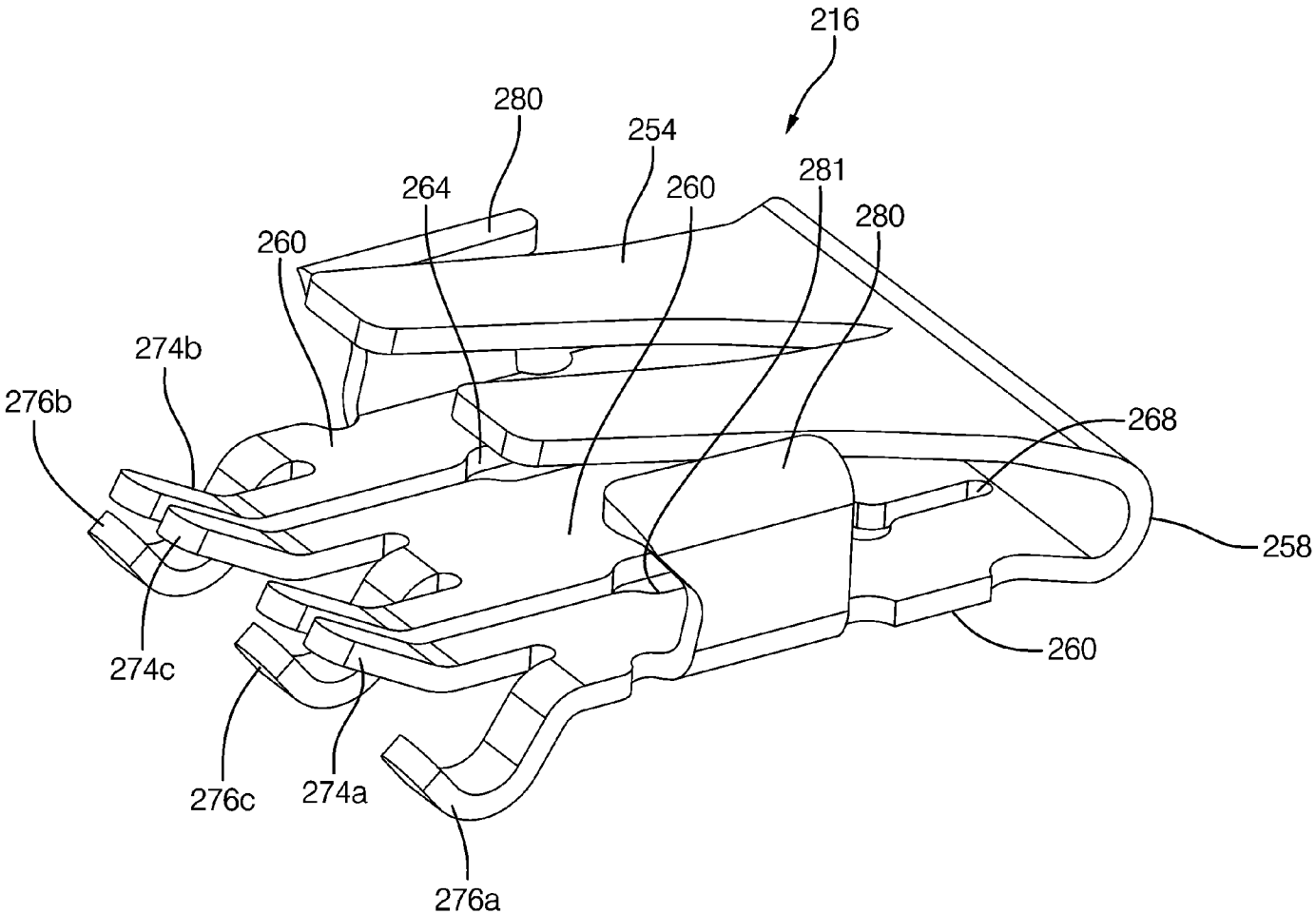
FIG. 15 is a perspective view with a shorting clip terminal having a plurality of second legs, according to an alternate embodiment of the invention.

Referring to FIG. 15, another alternate embodiment of the invention provides a shorting clip terminal 200 having a second leg 260 including a plurality of second legs greater than two as illustrated in the embodiment of FIGS. 5-7. Elements in the embodiment of FIG. 15 that are similar to elements in the embodiment of FIGS. 5-7 have element numbers differing by 200. Shorting clip terminal 200 allows for multiple female terminals in a first connector body 226 to be electrically shorted together through contact elements 276*a*, 276*b*, 276*c* of the shorting clip terminal 200 when a protrusion disengages lift elements 274*a*, 274*b*, 274*c* and is removed from a shorting clip terminal cavity when the first connector body is disconnected from the second connector body. The main protrusion portion may be further notched out to allow contact element 276*c* to make contact with an additional terminal in the first connector body. The shorting clip terminal cavity in the first connector body may be larger than the embodiment of FIGS. 5-7 to fit shorting clip terminal 200 and also allow for contact elements 276*a*, 276*b*, 276*c* of shorting clip terminal 200 to make electrical contact with the additional female terminals in the first connector body. The additional female terminals are preferably adjacent the shorting clip terminal cavity such that contact elements of the shorting clip terminal make electrical contact with the female terminals.

Thus, the invention provides a reliable shorting clip terminal connector assembly to produce a first and second state operation of the shorting clip terminal. The lift elements allow the shorting clip terminal to be reliably lifted by the main protrusion portion away from the female terminals in the first operation state such that damage to the shorting clip terminal with insertion of the protrusion in the cavity may decrease. Irrespective of environmental conditions surrounding the shorting clip terminal connector, the use of the portions of protrusion side walls intermediate the contact elements of the shorting clip terminal and the female terminals of the first connector body further provide a shield to ensure and keep the contact elements from making electrical contact with the first and the second female terminals when the second connector body is mated with the first connector body. The contact elements of the shorting clip terminal do not make contact with the protrusion during insertion and retraction of the protrusion from the cavity, and the contact elements are spaced apart from the portions of the protrusion side walls when the second connector body is mated to the first connector body. Because the contact elements do not make contact with the protrusion, pieces of the protrusion do not break free to become lodged in the apertures that may produce intermittent electrical contact of the contact elements with the female terminals. Material of the protrusion is also prevented from adherence to the contact elements to further reduce the possibility of intermittent electrical contact with female terminals. The slot between the plurality of second legs of the shorting clip terminal with the closed end adjacent the curved end allows for reliable independent movement of the plurality of second legs and allows the contact elements of the shorting clip terminal to make contact with the female terminals accounting for manufacturing tolerance variation of the shorting clip terminal connector assembly components when the protrusion is removed from the cavity when the first connector body is disconnected from the second connector body. An in-bound lift element from the contact elements of the shorting clip terminal enhance the ability of the wedge-shaped tip of the main protrusion portion to elevate and lift the lift element allowing the contact elements to not make contact the protrusion when the first and second connector body are mated.

While the present invention has been shown and described with reference to certain embodiments thereof, it will be understood by those skilled in the art that various changes in form and details may be made therein without departing from the spirit and scope of the present invention as defined by the appended claims.

All terms used in the claims are intended to be given their broadest ordinary meanings and their reasonable constructions as understood by those skilled in the art unless an explicit indication to the contrary is made herein. In particular, use of the singular articles such as "a," "the," "said," . . . et cetera, should be read to recite one or more of the indicated elements unless a claim recites an explicit limitation to the contrary.

We claim:

1. A shorting clip terminal connector assembly, comprising:

a first connector body disposed along a longitudinal axis, said first connector body defining cavities including at least a shorting clip terminal cavity and at least a first and a second cavity different from the shorting clip terminal cavity;

at least a first and a second terminal, said first cavity configured to axially receive the first terminal and said second cavity configured to axially receive the second terminal, and the first terminal providing a first electrical signal and the second terminal providing a second electrical signal;

a shorting clip terminal, said shorting clip terminal cavity configured to axially receive the shorting clip terminal, and the shorting clip terminal including a lift element and at least a first and a second contact element, said first contact element configured to be in electrical communication with the first terminal and said second contact element configured to be in electrical communication with said second terminal; and a second connector body being axially mateable with the first connector body and including a protrusion in alignment with the shorting clip terminal cavity, said protrusion including at least a first protrusion side wall and a second protrusion side wall, wherein when the second connector body is connected with the first connector body, the protrusion is inserted in the shorting clip terminal cavity and engages the lift element and urges the shorting clip terminal such that the first and the second contact element are lifted away from being in contact with at least the first and the second terminal to enable insertion of the first protrusion side wall intermediate the first terminal and the first contact element and insertion of the second protrusion side wall intermediate the second terminal and the second contact element within the cavity, and wherein the first and the second contact element do not make electrical contact with the first and the second terminal whereby the first electrical signal of the first terminal and the second electrical signal of the second terminal are not electrically shorted together through electrical contact with the shorting clip terminal, and the first and the second protrusion side wall further provide a shield to prevent the first contact element from making electrical contact with the first terminal and the second contact element from making electrical contact with the second terminal.

2. The shorting clip terminal connector assembly according to claim 1, wherein the first connector body defines a first aperture and a second aperture in the cavity, said first aperture being in communication with the shorting clip terminal cavity and the first terminal and said second aperture being in communication with the shorting clip terminal cavity and the second electrical contact, and when the second connector body is disconnected from the first connector body the protrusion slideably disengages from the lift element and the shorting clip terminal cavity allowing exertion of a tension force of the shorting clip terminal such that the first contact element of the shorting clip terminal makes electrical contact with the first terminal through the first aperture and the second contact element of the shorting clip terminal makes electrical contact with the second terminal through the second aperture, whereby the first electrical signal of the first terminal and the second electrical signal of the second terminal are electrically shorted through the shorting clip terminal.

3. The shorting clip terminal connector assembly according to claim 2, wherein the protrusion contacts the lift element and does not contact the first and the second contact element when the second connector body is mated with the first connector body, and the protrusion contacts the lift element and does not contact the first and the second contact element when the second connector body is disconnected with the first connector body.

4. The shorting clip terminal connector assembly according to claim 2, wherein the first protrusion side wall overlies and covers the first aperture and the second protrusion side wall overlies and covers the second aperture when the second connector body is mated with the first connector body.

5. The shorting clip terminal connector assembly according to claim 1, wherein the protrusion includes a main protrusion portion intermediate the first protrusion sidewall and the second protrusion side wall.

6. The shorting clip terminal connector assembly according to claim 5, wherein the main protrusion portion includes a wedge-shaped tip remote from an inner surface of the second body connector and the tip makes initial engagement with the lift element when the protrusion is received into the shorting clip terminal cavity, and the first protrusion side wall has a planar portion in an opposing, spaced relationship with the first contact element and the second protrusion side wall has a planar portion in an opposing, spaced relationship with the second contact element when the second connector body is mated with the first connector body.

7. The shorting clip terminal connector assembly according to claim 5, wherein the main protrusion portion has a first length, and the first protrusion side wall and the second protrusion side wall have a second length, and said first length is greater than said second length.

8. The shorting clip terminal connector assembly according to claim 5, wherein the protrusion has a pontoon-boat shape with the portions of the protrusion side walls representing pontoons in the pontoon-boat shape and the main protrusion portion represents a platform of the pontoon-boat shape, and a bottom side of the portions of the protrusion side walls have a parallel, spaced relationship with a bottom surface of the main protrusion portion.

9. The shorting clip terminal connector assembly according to claim 1, wherein the shorting clip terminal has a V-type shape including a first leg in connection with one end of a curved end and a second leg in connection with another end of the curved end, and the second leg extending farther away from the curved end than the first leg, and the second leg including a plurality of second legs, said plurality of second legs defining a slot between each second leg in the plurality of second legs, said slot having an open end remote from the curved end, and each second leg having a shape comprising a fork-type shape including tines, and the tines of each second leg include at least one lift element and at least one contact element, and the at least one lift element and the at least one contact element are disposed remote from the curved end.

10. The shorting clip terminal connector assembly according to claim 9, wherein a closed end of the slot is disposed adjacent the curved end.

11. The shorting clip terminal connector assembly according to claim 9, wherein the plurality of second legs include a plurality of shaft portions, and the tines being in connection with each shaft portion in the plurality of shaft portions, and a plane defined through the plurality of shaft portions comprises the at least one lift element and the at least one contact element not residing in the plane.

12. The shorting clip terminal connector assembly according to claim 9, wherein the plurality of second legs comprises a first leg and a second leg, and a contact element is disposed on a first and a second leg, respectively, in the plurality of second legs, and the contact element on the first and the second leg is configured to make electrical contact with the respective first and the second terminal, and a lift element is disposed on the first and second leg, respectively, in the plurality of second legs and is configured to make contact with a main body portion of the protrusion with insertion of the protrusion into the shorting clip terminal cavity, and the at least one lift element is in-bound from at least two contact elements.

13. A method to assemble a shorting clip terminal connector assembly for electrically shorting a first terminal with a second terminal dependent on a connection status of a first and a second connector body, the method comprising:

providing a shorting clip terminal, said shorting clip terminal includes a lift element and a first and a second contact element;

providing a first connector body including a shorting clip terminal cavity adapted to receive the shorting clip terminal, said first connector body including a first and a second terminal, the first terminal providing a first electrical signal and the second terminal providing a second electrical signal, and the shorting clip terminal configured to make electrical contact with the first terminal and the second terminal;

providing a second connector body mateable with the first connector body, said second connector body including a protrusion in alignment with the shorting clip terminal cavity;

providing a first terminal and a second terminal;

inserting the shorting clip terminal into the shorting clip terminal cavity in the first connector body;

inserting the first terminal into a first cavity and the second terminal into a second cavity in the first connector body, said first cavity being adapted to receive the first terminal and said second cavity being adapted to receive the second terminal, and the inserted first terminal being configured to slide under and lift the first contact element of the shorting clip terminal from the first cavity and into a ready position in the shorting clip terminal cavity while still being in contact with the first terminal and the inserted second terminal being configured to slide under and lift the second contact element of the shorting clip terminal from the second cavity and into a ready position in the shorting clip terminal cavity while still being in contact with the second terminal; and connecting the second connector body with the first connector body such that the protrusion is received into the shorting clip terminal cavity and slideably engages with the lift element of the inserted shorting clip terminal and urges the lift element to lift the first and the second contact element away from contact with the first terminal and the second terminal in the shorting clip terminal cavity to enable insertion of the first protrusion side wall intermediate the first terminal and the first contact element and insertion of the second protrusion side wall intermediate the second terminal and the second contact element such that the first and the second contact element do not make electrical contact with the first terminal and the second terminal whereby the first electrical signal of the first terminal and the second electrical signal of the second terminal are not electrically shorted together through electrical contact with the shorting clip terminal, and the first and the second protrusion side wall further provide a shield to prevent the first contact element from making electrical contact with the first terminal and the second contact element from making electrical contact with the second terminal when the first connector body is mated with second connector body.

14. The method according to claim 13, wherein the method steps of claim 13 are performed in the order recited.

15. The method according to claim 13, further including, disengaging the protrusion from the cavity when the second connector body is disconnected from the first connector body such that a tension force of the shorting clip terminal exerts the first contact element of the shorting clip terminal to make electrical contact with the first terminal through a first aperture in the shorting clip terminal cavity and the second contact element of the shorting clip terminal to make electrical contact with the second terminal through a second aperture in the shorting clip terminal cavity, whereby the first electrical signal of the first terminal and the second electrical signal of the second terminal are electrically shorted through the shorting clip terminal.

16. The method according to claim 15, wherein the steps of connecting the second connector body with the first connector body and disengaging the protrusion from the cavity further includes the main protrusion portion making contact with the lift element and the protrusion not making contact when the first and second contact element when the first connector body is mated with a second connector body and when the first connector body is disconnected from second connector body.

17. The method according to claim 13, wherein the step of connecting the second connector body to the first connector body further includes the first protrusion side wall overlying and covering a first aperture in the shorting clip terminal cavity and the second protrusion side wall overlying and covering a second aperture in the shorting clip terminal cavity when the second connector body is mated with the first connector body.

18. The method according to claim 13, wherein the step of providing the shorting clip terminal further includes the shorting clip terminal having a V-type shape including a first leg in connection with one end of a curved end and a second leg in connection with another end of the curved end, and the second leg extending farther away from the curved end than the first leg, and the second leg including a plurality of second legs, said plurality of second legs defining a slot between each second leg in the plurality of second legs, said slot having an open end remote from the curved end, and each second leg having a shape comprising a fork-type shape including tines, and the tines on each second leg include at least one lift element and at least one contact element, and the at least one lift element and the at least one contact element are disposed remote from the curved end with the at least one lift element being intermediate at least one contact element on one leg in the plurality of second legs and another at least one contact element on another leg in the plurality of second legs.

19. The method according to claim 18, wherein the step of providing the shorting clip terminal further includes a closed end of the slot being disposed adjacent the curved end.

20. A shorting clip terminal connector assembly, comprising:

a first connector body and a second connector body, said first connector body being mateable with said second connector body along an axis, and the first connector body defining a shorting clip terminal cavity and a pair of laterally spaced terminal cavities, said shorting clip terminal cavity being in communication with the pair of terminal cavities;

a first and a second terminal being disposed in the terminal cavities, respectively; and a shorting clip terminal axially disposed within the shorting clip terminal cavity, said shorting clip terminal having a first and a second contact tine configured to electrically contact the first and the second terminal, respectively, when the first connector body is disconnected from the second connector body, said shorting clip terminal further including at least one lift tine being disposed intermediate the first and the second contact tine element, wherein the second connector body includes an axially extending shorting clip lift protrusion, said lift protrusion being adapted to deflect the at least one lift tine and disconnect the first and the second contact tine from the first and the second terminal as the first and second connector body are mated without contacting the first and the second contact tine.

* * * * *